United States Patent [19]

Grundy

[11] 4,089,676

[45] May 16, 1978

[54] METHOD FOR PRODUCING NICKEL METAL POWDER

[75] Inventor: James D. Grundy, Williamsville, N.Y.

[73] Assignee: Williams Gold Refining Company Incorporated, Buffalo, N.Y.

[21] Appl. No.: 689,559

[22] Filed: May 24, 1976

[51] Int. Cl.[2] ..... C22B 23/04; C22C 1/04

[52] U.S. Cl. ..... 75/.5 AA; 75/108; 75/251

[58] Field of Search ..... 75/.5 A, .5 AA, .5 AB, 75/97 R, 97 A, 108, 109, 119, 251

[56] References Cited

U.S. PATENT DOCUMENTS

| | | | |
|---|---|---|---|
| 1,164,141 | 12/1915 | Sulzberger | 75/108 |
| 1,915,473 | 6/1933 | Raney | 75/.5 A |
| 2,836,485 | 5/1958 | Schaufelberger et al. | 75/108 |
| 3,399,050 | 8/1968 | Evans et al. | 75/108 |
| 3,966,463 | 6/1976 | Fraioli et al. | 75/108 |

FOREIGN PATENT DOCUMENTS

| | | | |
|---|---|---|---|
| 39-25273 | 10/1964 | Japan | 75/119 |

OTHER PUBLICATIONS

*Chemical Abstracts*, No. 15,725d; vol. 61; American Chemical Society (1964).

*Primary Examiner*—L. Dewayne Rutledge
*Assistant Examiner*—Michael L. Lewis
*Attorney, Agent, or Firm*—Christel & Bean

[57] ABSTRACT

A method for producing nickel powder of controlled geometry useful for conductive or resistive pastes or inks. A nickel salt is precipitated by means of hydrazine, an alkali metal base is added to the precipitate, and the resulting mixture is heated under ambient pressure until nickel powder is precipitated. The geometry such as powder surface area, particle size, and particle shape of the nickel powder end product is controlled by means of the added amount of alkali metal base or added amount of hydrazine and in some instances by means of the temperature.

10 Claims, No Drawings

METHOD FOR PRODUCING NICKEL METAL POWDER

BACKGROUND OF THE INVENTION

This invention relates to the production of nickel powder, and more particularly to a new and improved method for producing nickel powder of controlled geometry, such as powder surface area, particle size, and particle shape, for use in conductive or resistive pastes or inks or other uses and processes where surface area or particle size of the metal powder is important.

While nickel powders have been made by many processes, none has, to my knowledge, been controlled as to particle geometry. Probably the best known method of producing nickel powder has been the pyro-reduction of nickel carbonyl, [$Ni(CO)_4$], where the relatively elevated temperature results in particle growth and particle-particle sintering.

Experience with precious metals in the electronics industry indicates that chemical precipitation methods give the possibility of controlling the metal powder geometry. In considering some of the precipitating methods that have been used sucessfully for noble metals such as platinum or palladium, it is noted that the chemical activity of the reducing agent required to reduce a base metal compound to metal powder is much more than is required to reduce a noble metal compound. This is because base metal compounds are much more strongly bound together than noble metal compounds, and also base metal compounds usually precipitate as other compounds rather than as metals. The noble metals are unique in their ease of precipitation in metallic or uncombined condition.

Hydrazine is recognized chemically as a very powerful reducing agent and its use with noble metal compounds has been well documented. It also has been used for nickel compound reduction to nickel metal powder. However, the procedures taught by the prior art do not provide nickel powder of controlled geometry.

For example, Sulzberger, in U.S. Pat. No. 1,164,141 precipitates nickel, or cobalt, powder from several salts of nickel by the use of hydrazine or salts thereof and employs a platinum group metal salt to "incite" the reaction. This results in a combination metal powder, i.e. nickel plus palladium or platinum, which may, in many instances, be unsuitable for the envisioned uses of the nickel powder prepared according to the method of the present invention. In addition, the Sulzberger process does not provide nickel powder of controlled geometry.

Sharov et al. in articles abstracted by *Chemical Abstracts* (Volumes 64 and 65, 1966) disclose a process for producing nickel powder involving the precipitation from nickel hydroxide [$Ni(OH)_2$] by means of hydrazine. This, however, is specific for the hydroxide as specified by the equation given in the second article:

$$Ni^{2+} + N_2H_4 + OH^- \rightarrow Ni + N_2 + H_2O$$

The reduction product is also specified in the second article as (Beta)Ni + $Ni(OH)_2$ and in the first article, the percentage is specified as 93–6% metallic nickel. This product, containing 4–7% $Ni(OH)_2$ may be unsuitable for the envisioned uses of the nickel powder prepared according to the method of the present invention. In addition, the Sharov et al process does not provide nickel powder of controlled geometry.

Gershov et al, in an article abstracted by *Chemical Abstracts* (Volume 78, 1973), discloses an autocatalytic method of reducing nickel or cobalt chloride by the use of hydrazine which requires temperatures of 100°–140° C which, in turn, require a pressure vessel to accomplish the reduction. No control of particle geometry is offered.

Accordingly, while a number of procedures of the prior art have been used to precipitate nickel metal from solutions or slurries of nickel salts by means of hydrazine and/or its salts, none of these procedures provides a nickel powder wherein the geometry such as powder surface area, particle size and particle shape is controlled.

SUMMARY OF THE INVENTION

It is, therefore, an object of the present invention to provide a new and improved method for producing nickel powder having controlled geometry. It is a further object of the present invention to provide such a method for precipitation of controlled geometry nickel powder from nickel salts.

It is a further object of the present invention to provide such a method which can be repeated whereby each nickel powder of a particular controlled or selected geometry is continuously available.

It is a further object of the present invention to provide such a method which produces pure nickel powder essentially without contamination with other substances such as other metals or nickel compounds.

It is a further object of the present invention to provide such a method which is performed at easily attainable temperatures, ambient pressure, and without the need for a catalyst.

The present invention provides a method for producing nickel powder of controlled geometry useful for conductive or resistive pastes or inks. A nickel salt is precipitated by means of hydrazine, an alkali metal base is added to the precipitate, and the resulting mixture is heated under ambient pressure until nickel powder is precipitated. The geometry such as powder surface area, particle size, and particle shape of the nickel powder end product is controlled by means of the added amount of alkali metal base or added amount of hydrazine and in some instances by means of the temperature.

DETAILED DESCRIPTION OF THE INVENTION

The method of the present invention provides metallic nickel powder wherein the resulting geometry of the powder end product, i.e. the powder surface area, particle size and particle shape, can be controlled or varied by the method, in particular as a function of method parameters. One advantageous use of the nickel powder of controlled geometry is in conductive or resistive pastes or inks. Certain inks and pastes containing metal powder as the electrical conductor require metal powders of a considerable surface area. Other inks may require lesser surface area, for example, or low particle size or spherical as opposed to irregular shaped particles.

The method of the present invention is performed in the following manner. The following is an overall description of the method with quantitative information included in the examples thereafter. An appropriate nickel compound is dissolved in water in a suitable vessel under ambient pressure conditions and a reducing agent or precipitation agent in the form of hydrazine is added. The preferred agent is hydrazine hydrate, although hydrazine hydrochloride, hydrazine sulfate and other hydrazine salts can be employed. Upon addition of the hydrazine, a nickel complex is formed immediately as evidenced by a pink to blue precipitate. An antifoam agent, for example Union Carbide #7600, is added, and a measured amount of an alkali metal base, preferably sodium hydroxide, dissolved in water is added. While sodium hydroxide is preferred, potassium hydroxide and the other alkali metal hydroxides could be used. The measured amount of alkali metal base is determined according to the desired geometry of the nickel powder end product in a manner which will be described in detail presently. The resulting mixture or slurry is heated to a temperature in the range from about 88° C to about 92° C with stirring or similar agitation. Upon heating, the color of the original nickel complex changes to a purple-pink color. A measured amount of alkali metal base, i.e. sodium hydroxide, is added and the temperature is raised to a range from about 94° C to about 96° C. The temperature is maintained until it is observed that nickel powder is precipitated. The entire method is carried out under ambient pressure conditions. In carrying out the foregoing method, the alkali metal base need not be added in two parts. For example, it is advisable to add the base in two steps when making relatively large surface area powders to control the reaction rate.

The precipitated nickel powder is removed from the bottom of the vessel and filtered, preferably by means of a suction or vacuum type filter. The nickel powder then is washed, using deionized water, and then dried. The resulting nickel powder end product of controlled geometry then can be screened according to desired size. The nickel powder end product advantageously is observed to be non-pyrotechnic and non-pyrophoric. Thus, the finely divided particles of the nickel powder prepared according to the method of the present invention are observed to be non-combustible.

The method of the present invention is illustrated in further detail by the following examples.

EXAMPLE I

The method was carried out in the manner described above, and nickel salts from which nickel metal powder can be made according to the method of the present invention include nickel acetate, nickel carbonate, nickel chloride hexa hydrate, and nickel sulfate hexa hydrate, the latter being known in the plating industry as single nickel salt.

EXAMPLE II

The method was carried out in the manner described above, and it was determined that nickel ammonium sulfate, nickel nitrate, nickel oxide, and nickel sulfate hepta hydrate (known to the plating industry as double nickel salt) would not provide nickel metal powder from the method described above.

Examples III–IV are summarized in Table I as follows.

TABLE I

| Example No. | Ni Salt grams | (Ni) grams | $N_2H_4$ (ml) | NaOH grams | NaOH/Ni (g/g) | Powder Surface Area ($m^2/g$) | Particle Size (μm) | Particle Shape |
|---|---|---|---|---|---|---|---|---|
| III | 550 | (122.82) | 300 | 10 | .08 | 0.98 | 2.74 | Spherical |
| IV | 550 | (122.82) | 300 | 30.5 | .25 | 6.88 | 0.78 | Spherical-Irregular |
| V | 716 | (159.88) | 400 | 40 | .25 | 7.10 | .57 | Spherical-Irregular |
| VI | 250 | (55.83) | 125 | 60 | 1.07 | 10.5 | 0.32 | Irregular |
| VII | 22,171 | (4950.78) | 11,550 | 5331.5 | 1.08 | 11.69 | .14 | Irregular |

The data presented in Table I was obtained by carrying out the method as described above for each of the Examples III–VIII with the indicated amounts of nickel salt in grams, hydrazine in milliliters, and sodium hydroxide in grams. Nickel sulfate hexa hydrate was the nickel salt. The powder surface area in square meters per gram was obtained by the instrumental BET method which is a known method of measuring the surface area of a finely divided powder using nitrogen absorption. The particle size in micro meters is an average particle size obtained by the Fisher Sub Sieve Size procedure.

The examples presented in Table I indicate that increasing the caustic, i.e. sodium hydroxide, relative to the nickel of the nickel salt results in a nickel powder end product of greater surface area. Similarly, decreasing the proportion of sodium hydroxide to nickel in the salt gives a nickel powder end product of lesser surface area. Similarly, increasing the proportion of sodium hydroxide to nickel in the salt results in a nickel powder end product of decreasing particle size, and decreasing the proportion of base to nickel results in increasing particle size. In addition, the resulting nickel powder end products of lower powder surface area were observed to have particles of spherical shape, those of medium powder surface area were observed to be shperical with surface irregularities, and those of greater powder surface area were observed to vary from spherical to relatively irregular particle shapes. Table II presents data obtained from production runs carried out according to the method as described above.

TABLE II

| RUN NO. | Ni Salt (kg) | (Ni) (Kg) | $N_2H_4$ liters | NaOH (Kg) | Temp (° C) | NaOH (Kg) | Total NaOH/Ni (Kg/Kg) | Tap Density ($g/cm^3$) | Particle Size m | Powder Surface Area $m^2/g$ |
|---|---|---|---|---|---|---|---|---|---|---|
| 1 | 22.16 | (4.95) | 10.5 | 3.41 | 88 | 1.82 | 1.06 | .52 | .35 | 17.60 |
| 2 | 22.16 | " | 10.5 | 3.41 | 90.92 | 1.82 | 1.06 | .76 | .37 | 14.97 |
| 3 | 22.16 | " | 10.5 | 3.41 | 90.92 | 1.82 | 1.06 | .75 | .40 | 10.04 |
| 4 | 22.16 | " | 11 | | 90 | .75 | 0.15 | .62 | .90 | 5.60 |
| 5 | 22.16 | " | 11.5 | 3.41 | 88 | 1.82 | 1.06 | 1.49 | .83 | 5.33 |
| 6 | 22.16 | " | 11.5 | 3.41 | 96 | 1.82 | 1.06 | 2.59 | 1.58 | 4.28 |

The nickel salt used was nickel sulfate hexa hydrate. The temperatures given are the temperature of solution at second addition of NaOH. The tap density is of the resulting nickel powder end product, and the particle size and powder surface area were determined in a manner identical to that of the previous examples.

The data presented in Table II indicates that increasing hydrazine relative to the amount of nickel in the nickel salt provides nickel powder end products of decreasing powder surface area. This can be seen by comparing run numbers 1, 4, 5 or 6. Increasing hydrazine relative to nickel in the salt provides powders of increasing tap density. Increased temperature of solution when the second addition of caustic, i.e. sodium hydroxide, is made results in nickel powder end products of lower powder surface area. This is seen by comparing run #1 with run #2 and run #5 with run #6.

In order to provide nickel powders having relatively smaller powder surface areas, a moderator or inhibitor in the form of calcium hydroxide is added after the nickel salt is dissolved in water, although it possibly could be added later in the process. Two production runs similar to those of Table II were performed, using nickel sulfate hexa hydrate were performed and the results are summarized in Table III as follows.

TABLE III

| Ni Salt (Kg) | (Ni) (Kg) | $Ca(OH)_2$ grams | $N_2H_4$ liters | Temp. (° C) | NaOH (Kg) | Temp. (° C) | NaOH (Kg) | NaOH/Ni Kg/Kg | Tap Density g/cm$^3$ | Particle Size m | Powder Surface Area m$^2$/g |
|---|---|---|---|---|---|---|---|---|---|---|---|
| 21.00 | (4.69) | 60 | 9.375 | 88–92 | 1.0 | 88–92 | .125 | .24 | 1.02 | 2.58 | 2.58 |
| 21.00 | (4.69) | 60 | 9.375 | 88–92 | 1.0 | 88–92 | .125 | .24 | 1.39 | 1.48 | 2.83 |

Table III illustrates another important advantage of the method of the present invention in that is can be repeated whereby each nickel powder of particular controlled or selected geometry is continuously available. In other words, the method of the present invention produces a given nickel powder geometry reproducibly. Thus, in comparing the data from the two runs presented in Table III, two nickel powder end products having substantially similar powder surfaces areas were obtained.

The method of the present invention is further illustrated by the following flow chart.

Nickel Process Flow Chart

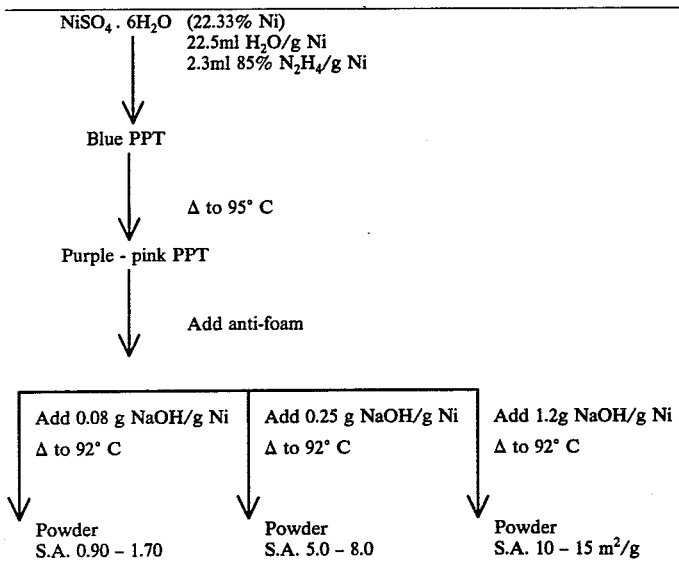

Thus the following ranges can be deduced from the foregoing examples with gram weights converted moles: alkali metal base in amounts of about 0.117 to about 1.76 moles per mole of nickel; with hydrazine in a range of about 2.0 to 2.5 milliliters per gram of nickel.

It is therefore apparent that the present invention accomplishes its intended objects. While the present invention has been described in detail, this is for the purpose of illustration, not limitation.

I claim:

1. A method for producing nickel powder of controlled geometry from a nickel salt comprising:

a. adding hydrazine to a nickel salt to form a precipitate;

b. adding an alkali metal base to said precipitate;

c. controlling the geometry of the ultimate nickel powder end product by selecting the amount of said base in a range from about 0.117 to about 1.76 moles of alkali metal base per mole of nickel in said salt while maintaining the amount of said hydrazine in a range from about 2.0 to about 2.5 milliliters of hydrazine per gram of nickel in said salt; and d. heating the resulting mixture to precipitate nickel powder.

2. A method according to claim 1, including varying the amount of said base relative to the amount of nickel in said salt to vary the powder surface area of the resulting nickel powder end product.

3. A method according to claim 1, including varying the amount of said base relative to the amount of nickel in said salt to vary the particle size of the resulting nickel powder end product.

4. A method according to claim 1, including varying the amount of said base relative to the amount of nickel in said salt to vary the particle shape of the resulting nickel powder end product.

5. A method according to claim 1, including varying the amount of said hydrazine relative to the amount of nickel in said salt to vary the particle density of the resulting nickel powder end product.

6. A method according to claim 1, further including adding a moderator to affect the function of the alkali metal base in a manner providing a resulting nickel powder end product of lesser powder surface area.

7. A nickel powder product of controlled density prepared by the method of claim 1.

8. A method according to claim 1, wherein said step of heating is performed at a temperature below about 96° C.

9. A method according to claim 1, wherein said nickel salt is selected from the group consisting of nickel acetate, nickel carbonate, nickel chloride hexa hydrate and nickel sulfate hexa hydrate.

10. A method for producing nickel powder of controlled geometry from a nickel salt comprising:

a. adding hydrazine to a nickel salt to form a precipitate;
b. adding an alkali metal base to said precipitate;
c. heating the precipitate in a first temperature range below about 96° C;
d. adding an alkali metal base to the heated precipitate;
e. heating the resulting mixture in a second temperature range below about 96° C to precipitate nickel powder, said second temperature range being selected to control the geometry of the nickel powder end product; and
f. at least one of said hydrazine and said base being added in an amount selected to control the geometry of the nickel powder end product.

* * * * *